US010422049B2

(12) United States Patent
Wijenberg et al.

(10) Patent No.: US 10,422,049 B2
(45) Date of Patent: Sep. 24, 2019

(54) METHOD FOR PLATING A MOVING METAL STRIP AND COATED METAL STRIP PRODUCED THEREBY

(71) Applicant: TATA STEEL IJMUIDEN B.V., Velsen-Noord (NL)

(72) Inventors: Jacques Hubert Olga Joseph Wijenberg, Amsterdam (NL); Jeroen Martijn Link, Haarlem (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 0 days.

(21) Appl. No.: 15/308,017

(22) PCT Filed: May 21, 2015

(86) PCT No.: PCT/EP2015/061332
§ 371 (c)(1),
(2) Date: Oct. 31, 2016

(87) PCT Pub. No.: WO2015/177314
PCT Pub. Date: Nov. 26, 2015

(65) Prior Publication Data

US 2017/0081773 A1 Mar. 23, 2017

(30) Foreign Application Priority Data

May 21, 2014 (EP) ..... 14169312

(51) Int. Cl.
*C25D 9/10* (2006.01)
*C25D 7/06* (2006.01)
*C25D 9/08* (2006.01)

(52) U.S. Cl.
CPC ..... *C25D 9/10* (2013.01); *C25D 7/0621* (2013.01); *C25D 9/08* (2013.01)

(58) Field of Classification Search
CPC ..... C25D 3/06
See application file for complete search history.

(56) References Cited

U.S. PATENT DOCUMENTS 3,954,574 A 5/1976 Gyllenspetz et al.
4,461,680 A 7/1984 Lashmore
(Continued)

FOREIGN PATENT DOCUMENTS

EP 0467858 * 1/1992 ..... C25D 11/38
EP 0747510 A1 12/1996
(Continued)

OTHER PUBLICATIONS

International Search Report and Written Opinion dated Aug. 19, 2015 from International Application PCT/PCT/EP2015/061332 to Tata Steel Ijmuiden B.V. filed May 21, 2015.

*Primary Examiner* — Stefanie S Wittenberg
(74) *Attorney, Agent, or Firm* — Vorys, Sater, Seymour and Pease LLP

(57) ABSTRACT

A method for producing a steel substrate coated with a chromium metal-chromium oxide (Cr—CrOx) coating layer in a continuous high speed plating line, operating at a line speed (v1) of at least 100 m·min$^{-1}$, wherein one or both sides of the electrically conductive substrate in the form of a strip, moving through the line, is coated with a chromium metal-chromium oxide (Cr—CrOx) coating layer from a single electrolyte by using a plating process. A coated steel substrate and a packaging made thereof.

17 Claims, 4 Drawing Sheets

(56) References Cited

U.S. PATENT DOCUMENTS

| | | | | |
|---|---|---|---|---|
| 4,520,077 | A * | 5/1985 | Lavezzari | C25D 11/38 428/632 |
| 4,804,446 | A | 2/1989 | Lashmore et al. | |
| 6,004,448 | A | 12/1999 | Martyak | |
| 2005/0121332 | A1 | 6/2005 | Kochilla et al. | |
| 2011/0168051 | A1* | 7/2011 | Kuwano | C01G 37/00 106/1.25 |
| 2012/0024714 | A1* | 2/2012 | Kwon | C25D 3/06 205/287 |
| 2013/0029176 | A1 | 1/2013 | Kadowaki et al. | |
| 2015/0064494 | A1 | 3/2015 | Wijenberg et al. | |

FOREIGN PATENT DOCUMENTS

| | | | |
|---|---|---|---|
| EP | 2557202 | A1 | 2/2013 |
| WO | 2005033371 | A2 | 4/2005 |
| WO | 2013143928 | A1 | 10/2013 |

* cited by examiner

METHOD FOR PLATING A MOVING METAL STRIP AND COATED METAL STRIP PRODUCED THEREBY

CROSS-REFERENCE TO RELATED APPLICATIONS

This is a § 371 National Stage Application of International Application No. PCT/EP2015/061332 filed on May 21, 2015, claiming the priority of European Patent Application No. 14169312.7 filed on May 21, 2014.

This invention relates to a method for producing a coated steel substrate in a continuous high speed plating line and to a coated metal strip produced using said method.

Electroplating or (in short) plating is a process that uses electrical current to reduce dissolved metal cations so that they form a coherent metal coating on an electrode. Electroplating or electrodeposition is primarily used to change the surface properties of an object (e.g. abrasion and wear resistance, corrosion protection, lubricity, aesthetic qualities, etc.). The part to be plated is the cathode in the circuit. Usually, the anode is made of the metal to be plated on the part. Both components are immersed in a solution called an electrolyte containing one or more dissolved metal salts as well as other ions that permit the flow of electricity. A power supply supplies a direct current to the anode, oxidizing the metal atoms that comprise it and allowing them to dissolve in the solution. At the cathode, the dissolved metal ions in the electrolyte solution are reduced at the interface between the solution and the cathode, such that they "plate out" onto the cathode. The rate at which the anode is dissolved is equal to the rate at which the cathode is plated, vis-a-vis the current flowing through the circuit. In this manner, the ions in the electrolyte bath are continuously replenished by the anode.

Other electroplating processes may use a non-consumable anode such as lead or carbon. In these techniques, ions of the metal to be plated must be replenished in the bath as they are drawn out of the solution.

Chromium plating is a technique of electroplating a thin layer of chromium onto a metal object. The chromium layer can be decorative, provide corrosion resistance, or increase surface hardness.

Traditionally, the electrodeposition of chromium was achieved by passing an electrical current through an electrolyte solution containing hexavalent chromium (Cr(VI)). However, the use of Cr(VI) electrolyte solutions is problematic in view of the toxic and carcinogenic nature of Cr(VI) compounds. Research in recent years has therefore focused on finding suitable alternatives to Cr(VI) based electrolytes. One alternative is to provide a trivalent chromium Cr(III) based electrolyte since such electrolytes are not toxic and afford chromium coatings similar to those that are deposited from Cr(VI) electrolyte solutions.

For some types of packaging steels chromium coated steel is produced. Chromium coated steel for packaging purposes is normally a sheet or strip of steel electrolytically coated with a layer of chromium and chromium oxide with a coating thickness of <20 nm. Originally called TFS (Tin Free Steel), it is now better known by the acronym ECCS (Electrolytic Chromium Coated Steel). ECCS is typically used in the production of DRD (Drawn & Redrawn) two-piece cans and components that do not have to be welded, such as ends, lids, crown corks, twist-off caps and aerosol bottoms and tops. ECCS excels in adhesion to organic coatings, both lacquers and polymer coatings, like PET or PP coatings, which provide robust protection against a wide range of aggressive filling products, as well as excellent food safety standards, being both Bisphenol A and BADGE free. Up till now ECCS was produced based on a Cr(VI) process. Conventional Cr(III) processes proved to be incapable of replicating the quality of the Cr(VI) based layers because the Cr(III) processes resulted in amorphous and/or porous layers, rather than crystalline and dense layers. However, recent developments show that coating layers can be successfully deposited on the basis of a Cr(III)-based electrolyte as demonstrated by WO2013143928.

In industrial processes it is important to produce quickly and cost effectively. However, conventional processes result in the need to apply increasing current densities with increasing strip speeds. Higher current densities result in a faster deposition rate, but also in higher costs for electricity and for high electric power equipment.

It is an object of the present invention to provide a method that provides a chromium-chromium oxide (Cr—CrOx) layer on a steel substrate in a single plating step at high speed with lower plating current densities.

It is also an object of the present invention to produce a chromium-chromium oxide (Cr—CrOx) layer on a steel substrate in a single plating step at high speed from a simple electrolyte.

It is also an object of the present invention to produce a chromium-chromium oxide (Cr—CrOx) layer by plating it on a steel substrate at high speed from a simple electrolyte based on trivalent Cr chemistry.

One or more of these objects can be achieved by for producing a steel substrate coated with a chromium metal-chromium oxide (Cr—CrOx) coating layer in a continuous high speed plating line, operating at a line speed (v1) of at least 100 $m \cdot min^{-1}$, wherein one or both sides of the electrically conductive substrate in the form of a strip, moving through the line, is coated with a chromium metal-chromium oxide (Cr—CrOx) coating layer from a single electrolyte by using a plating process, wherein the substrate is a steel substrate which acts as a cathode and wherein the CrOx deposition is driven by the increase of the pH at the substrate/electrolyte interface (i.e. surface pH) due to the reduction of $H^+$ to $H_2(g)$, and wherein the increase of pH is counteracted by a diffusion flux of $H^+$-ions from the bulk of the electrolyte to the substrate/electrolyte interface and wherein this diffusion flux of $H^+$-ions from the bulk of the electrolyte to the substrate/electrolyte interface is reduced by increasing the kinematic viscosity of the electrolyte and/or by moving the strip and the electrolyte through the plating line in concurrent flow wherein the steel strip is transported through the plating line with a velocity (v1) and wherein the electrolyte is transported through the strip plating line with a velocity of v2, thereby reducing the current density to deposit CrOx and reducing the amount of $H_2(g)$ formed at the substrate/electrolyte interface. Dependent on the type of metal, it is possible that some of the metal oxide is further reduced to metal. It was found by the present inventors that this happens in case of Cr.

The term metal oxide encompasses all compounds including $Me_xO_y$ compounds, where x and y may be integers or real numbers, but also compounds like hydroxide $Me_x(OH)_y$ or mixtures thereof, where Me=Cr.

A high speed continuous plating line is defined as a plating line through which the substrate to be plated, usually in the form of a strip, is moved at a speed of at least 100 $m \cdot min^{-1}$. A coil of steel strip is positioned at the entry end of the plating line with its eye extending in a horizontal plane. The leading end of the coiled strip is then uncoiled and welded to the tail end of a strip already being processed.

Upon exiting the line the coils are separated again and coiled, or cut to a different length and (usually) coiled. The electrodeposition process can thus continue without interruption, and the use of strip accumulators prevents the need for speeding down during welding. It is preferable to use deposition processes which allow even higher speeds. So the method according to the invention preferably allows producing a coated steel substrate in a continuous high speed plating line, operating at a line speed of at least 200 $m \cdot min^{-1}$, more preferably of at least 300 $m \cdot min^{-1}$ and even more preferably of at least 500 $m \cdot min^{-1}$. Although there is no limitation to the maximum speed, it is clear that control of the deposition process, the prevention of drag-out and of the plating parameters and the limitations thereof becomes more difficult the higher the speed. So as a suitable maximum the maximum speed is limited at 900 $m \cdot min^{-1}$.

This invention relates to the deposition of chromium and chromium oxide layer (Cr—CrOx) from an aqueous electrolyte by means of electrolysis in a strip plating line. The deposition of CrOx is driven by the increase of the surface pH due to the reduction of $H^+$ (more formally: $H_3O^+$) to $H_2(g)$ at the strip surface (being the cathode), and not by the regular plating process in which metal ions are discharged by means of an electrical current according to: $Me^{n+}(aq) + n \cdot e^- \rightarrow Me(s)$. In such a process, increasing the current density is sufficient to achieve the same plated thickness when the strip speed increases (provided the diffusion of metal ions to the substrate is not a limiting factor).

In an embodiment this invention relates to the deposition of a chromium and chromium oxide layer (Cr—CrOx) from a trivalent chromium electrolyte by means of electrolysis in a strip plating line. The deposition of CrOx is driven by the increase of the surface pH due to the reduction of $H^+$, and not by the regular plating process in which metal ions are discharged by means of an electrical current. The linear relationship shown in FIG. 3 provides evidence for the hypothesis that the deposition of $Cr(HCOO)(H_2O)_3(OH)_2(s)$ on the electrode surface is driven by the diffusion flux. In a second stage, the $Cr(HCOO)(H_2O)_3(OH)_2(s)$ deposit is partly further reduced to Cr-metal and partly converted into Cr-carbide.

The mechanism of a deposition process from a Cr(III)-based electrolyte is believed to be as follows. When the current density is increased, the surface pH becomes more alkaline and $Cr(OH)_3$ is deposited if pH>5. This experimental behaviour can be explained qualitatively by assuming the following chain of equilibrium reactions:

$$Cr^{3+} + OH^- \Leftrightarrow Cr(OH)^{2+}$$

$$Cr(OH)^{2+} + OH^- \Leftrightarrow Cr(OH)_2^+$$

$$Cr(OH)_2^+ + OH^- \Leftrightarrow Cr(OH)_3$$

Or, more accurately in case the formate ion ($HCOO^-$) is the complexing agent:

$$[Cr(HCOO)(H_2O)_5]^{2+} + OH^- \rightarrow [Cr(HCOO)(OH)(H_2O)_4]^+ + H_2O \quad \text{(regime I)}$$

$$[Cr(HCOO)(OH)(H_2O)_4]^+ + OH^- \rightarrow Cr(HCOO)(OH)_2(H_2O)_3 + H_2O \quad \text{(regime II)}$$

$$Cr(HCOO)(OH)_2(H_2O)_3 + OH^- \rightarrow [Cr(HCOO)(OH)_3(H_2O)_2]^- + H_2O \quad \text{(regime III)}$$

The regimes I-III are visible when the deposition of chromium is plotted against the current density (cf. for example FIG. 4). Regime I is the region where there is a current, but no deposition yet. The surface pH is insufficient for chromium deposition. Regime II is when the deposition starts and increases linearly with the current density until it peaks and drops of in regime III where the deposit starts to dissolve.

When the surface pH becomes too alkaline (pH>11.5), $Cr(OH)_3$ will dissolve again:

$$Cr(OH)_3 + OH^- \rightarrow Cr(OH)_4^-$$

Because $H^+$ ions are reduced at the strip surface, the concentration of $H^+$ ions will decrease near the strip surface. Consequently, a concentration gradient will be established adjacent to the strip surface. FIG. 1 shows the Nernst diffusion layer adjacent to the electrode ($c_s$: surface concentration [$mol \cdot m^{-3}$], $c_b$: bulk concentration [$mol \cdot m^{-3}$], δ: diffusion layer thickness [m], x: distance from electrode [m]).

The term single plating step intends to mean that the Cr—CrOx is deposited from one electrolyte in one deposition step. The deposition of a complex $Cr(HCOO)(H_2O)_3(OH)_2(s)$ on the surface of the substrate is immediately followed by the formation of Cr-metal, Cr-carbide and some remaining CrOx when the deposition takes place at a current density within regime II. The higher the current density used in regime II, the higher the amount of Cr-metal in the final deposit (see FIG. 7). Obviously one can choose to subsequently deposit one or more layers. When one deposits for example 2 layers, then each of these layers would be deposited from one electrolyte in one deposition step.

In the well-known Nernst diffusion layer concept, one assumes that a stagnant layer of thickness δ exists near the electrode surface. Outside this layer, convection maintains the concentration uniform at the bulk concentration. Within this layer, mass transfer occurs only by diffusion.

The diffusion flux J at the strip surface is given by Fick's first law:

$$J = [mol m^{-2} s^{-1}] = D\left(\frac{\partial c}{\partial x}\right)_{x=0} = D\left(\frac{c_b - c_s}{\delta}\right)$$

where D is the diffusion coefficient [$m^2 s^{-1}$].

In scientific literature, expressions for the diffusion layer thickness have been derived for many practical cases, like a rotating disk (Levich), a rotating cylinder (Eisenberg), a flow in a channel (Pickett), and also a moving strip (Landau). According to an expression derived by Landau the diffusion flux at the strip surface is proportional with the strip speed to the power 0.92: $J \approx v_s^{0.92}$. This means that the diffusion layer thickness becomes thinner at increasing strip speed.

For normal strip plating processes, e.g. plating of tin, nickel or copper, this increase of the diffusion flux with increasing strip speed is very advantageous, because then a higher current density can be applied and a higher deposition rate is obtained. In the plating process of these metals metal ions are discharged (reduced) to metal at the cathode by means of an electrical current and the reduced metal ions (i.e. metal atoms) are deposited onto the cathode (the metal strip).

But, in case of CrOx deposition, this increase of the diffusion flux with increasing strip speed is counterproductive, because the surface pH increase, which is required to deposit $Cr(OH)_3$, is thwarted (counteracted) by the faster transport (replenishment) of $H^+$ ions from the bulk of the electrolyte to the strip surface. Thus, at a higher strip speed an increasingly higher current density is required to deposit the same amount of $Cr(OH)_3$. FIG. 2 shows that the deposition of $Cr(OH)_3$ via electrolysis of $H^+$ leading to increase of surface pH at cathode (i.e. steel strip). Once CrOx (in the form of e.g. $Cr(OH)_3$) is deposited, part of this deposit is reduced to metallic Cr.

FIG. 3 shows the current density as a function of the strip speed required for depositing 60 $mg \cdot m^{-2}$ Cr as $Cr(OH)_3$. These data were obtained from a Rotating Cylinder Electrode (RCE) study by equating mass transfer rate equations for an RCE and a Strip Plating Line (SPL). Clearly, an increasingly higher current density is required to deposit the same amount of $Cr(OH)_3$ at a higher strip speed.

Higher current densities not only demand more powerful (and expensive) rectifiers, but also imply a higher risk of unwanted side reactions at the anode, like the oxidation of Cr(III) to Cr(VI). Moreover, when more $H_2(g)$ is formed at the strip surface, an exhaust system with a larger capacity is required to stay below the explosion limit of the hydrogen-air mixture. And also, there is the increased risk of damaging the catalytic layer on the anode at higher current densities.

Also, when more $H_2(g)$ is formed at the strip surface, the risk of pinhole formation in the coating as a result of $H_2$-bubbles adhering to the metal surface increases as well.

The invention is therefore based on the notion to increase the diffusion layer thickness, which is counterintuitive as most electrodeposition reactions benefit from a thin diffusion layer.

The inventors found that the diffusion layer thickness can be increased by increasing the kinematic viscosity of the electrolyte.

The invention will now be explained further by means of a non-limitative embodiment.

In WO2013143928 an electrolyte was used for the Cr—CrOx deposition comprising 120 $g \cdot l^{-1}$ basic chromium sulphate, 250 $g \cdot l^{-1}$ potassium chloride, 15 $g \cdot l^{-1}$ potassium bromide and 51 $g \cdot l^{-1}$ potassium formate. The pH was adjusted to values between 2.3 and 2.8 measured at 25° C. by the addition of sulphuric acid. Further investigations showed that it is preferable to replace the chlorides by sulphates to prevent $Cl_2(g)$ formation. The present inventors discovered that bromide in a chloride based electrolyte does not prevent the oxidation of Cr(III) to Cr(VI) at the anode as is wrongfully claimed in U.S. Pat. Nos. 3,954,574, 4,461,680, 4,804,446, 6,004,448 and EP0747510, but bromide reduces chlorine formation. So, when chlorides are replaced by sulphates, bromide can be safely removed from the electrolyte, because it serves no purpose anymore. By using a suitable anode the oxidation of Cr(III) to Cr(VI) at the anode in a sulphate based electrolyte can be prevented. The electrolyte then consists of an aqueous solution of a Cr(III) salt, preferably a Cr(III) sulphate, a conductivity enhancing salt in the form of potassium sulphate and potassium formate as a chelating agent and optionally some sulphuric acid to obtain the desired pH at 25° C. This solution is taken as a benchmark against which the invention is compared.

TABLE 1a

Trivalent chromium electrolyte with $K_2SO_4$

| compound | molar mass [$g \cdot mol^{-1}$] | CAS No. | c [$g \cdot l^{-1}$] | c [M] |
|---|---|---|---|---|
| $CrOHSO_4 \times Na2SO_4 \times nH_2O$ 16.7 wt-% Cr | 307.11 (n = 0) | [10101-53-8] | 120 | 0.385 |
| potassium sulphate ($K_2SO_4$) | 174.26 | [7778-80-5] | 80 | 0.459 |
| potassium formate ($CHKO_2$) | 84.12 | [590-29-4] | 51.2 | 0.609 |

The pH was adjusted to 2.9 at 25° C. by the addition of $H_2SO_4$.

TABLE 1b

Trivalent chromium electrolyte with $Na_2SO_4$

| compound | molar mass [$g \cdot mol^{-1}$] | CAS No. | c [$g \cdot l^{-1}$] | c [M] |
|---|---|---|---|---|
| $CrOHSO_4 \times Na_2SO_4 \times nH_2O$ 16.7 wt-% Cr | 307.11 (n = 0) | [10101-53-8] | 120 | 0.385 |
| sodium sulphate ($Na_2SO_4$) | 142.04 | [7757-82-6] | 250 | 1.760 |
| sodium formate ($CHNaO_2$) | 68.01 | [141-53-7] | 41.4 | 0.609 |

The pH was adjusted to 2.9 at 25° C. by the addition of $H_2SO_4$. Clearly, the solubility of $Na_2SO_4$ (1.76 M) is much higher than the solubility of $K_2SO_4$ (0.46 M). For the electrodeposition experiments titanium anodes comprising a catalytic coating of iridium oxide or a mixed metal oxide are chosen. Similar results can be obtained by using a hydrogen gas diffusion anode. The rotational speed of the RCE was kept constant at 10 $s^{-1}$ ($\Omega^{0.7}$=5.0). The substrate was a 0.183 mm thick cold rolled blackplate material and the dimensions of the cylinder were 113.3 mm×ø73 mm. The cylinders were cleaned and activated under the following conditions prior to plating.

TABLE 2

Pretreatment of the substrate

| | step 1 cleaning | step 2 activation |
|---|---|---|
| solution composition | 50 $ml \cdot l^{-1}$ Chela Clean KC-25H | 25 $g \cdot l^{-1}$ $H_2SO_4$ |
| temperature (° C.) | 60 | 25 |
| current density ($A \cdot dm^{-2}$) | +1.5 (anodic) | 0 (dip) |
| Time (s) | 60 | 1.5 |

An Anton Paar Model MCR 301 Rheometer was used for the viscosity measurements. The kinematic viscosity ν ($m^2 \cdot s^{-1}$) can be calculated by dividing the measured dynamic viscosity ($kg \cdot m^{-1} \cdot s^{-1}$) by the density ($kg \cdot m^{-3}$). The conductivity was measured with a Radiometer CDM 83 conductivity meter.

The results of the viscosity and conductivity measurements at 50° C. are as follows.

TABLE 3

Viscosity and conductivity

| | dynamic viscosity (cP) = (0.01 $g \cdot cm^{-1} \cdot s^{-1}$) | density ($g \cdot cm^{-3}$) | kinematic viscosity ($m^2 \cdot s^{-1}$) | conductivity ($S \cdot m^{-1}$) | |
|---|---|---|---|---|---|
| 80 $g \cdot l^{-1}$ $K_2SO_4$ | 1.02 | 1.181 | 8.64E−07 | 13.5 | K |
| 100 $g \cdot l^{-1}$ $Na_2SO_4$ | 1.43 | 1.175 | 1.22E−06 | 13.1 | Na |
| 150 $g \cdot l^{-1}$ $Na_2SO_4$ | 1.57 | 1.209 | 1.30E−06 | 14.5 | Na |
| 200 $g \cdot l^{-1}$ $Na_2SO_4$ | 1.81 | 1.245 | 1.45E−06 | 15.6 | Na |
| 250 $g \cdot l^{-1}$ $Na_2SO_4$ | 2.43 | 1.284 | 1.89E−06 | 15.0 | K |

Despite the conductivity of a potassium solution being higher than that of a sodium solution for the same concentration, the conductivity of 250 $g \cdot l^{-1}$ sodium sulphate is higher than that of 80 $g \cdot l^{-1}$ potassium sulphate.

The last column of the table indicates whether potassium formate (51.2 g/l or 0.609 M) or sodium formate (41.4 g/l, or 0.609 M) was used as complexing agent. The difference in formate also explains why the electrolyte with 250 g/l $Na_2SO_4$ has a lower conductivity than the electrolyte with 200 g/l $Na_2SO_4$.

The diffusion flux for a RCE is proportional with $\nu^{-0.344}$ (Eisenberg, J. Electrochem. Soc., 101 (1954), 306)

$$J=0.0642D^{0.644}\nu^{-0.344}r^{0.4}(c_b-c_s)\omega^{0.7}$$

with $\omega=2\pi\Omega$

Inserting the measured kinematic viscosity values (the diffusion coefficient D is divided out, because it is a ratio), it is expected that the diffusion flux (and also the current) for the $Na_2SO_4$ electrolyte will be 24% smaller than for the $K_2SO_4$ electrolyte:

$$\frac{J_{Na_2SO_4}}{J_{K_2SO_4}}=\left(\frac{1.89\times10^{-6}}{8.64\times10^{-7}}\right)^{-0.344}=0.76$$

When the current becomes smaller, also the potential will become smaller, because the potential is directly proportional with the current for all ohmic resistances (according to Ohm's law: V=IR) in the electrical circuit. Neglecting polarisation resistances at the electrodes, the rectifier power is given by:

$$P=VI=I^2R$$

where R represents the sum of all resistances in the electrical circuit (electrolyte, bus bars, bus joints, anodes, conductor rolls, carbon brushes, strip, etc.). So, the expected rectifier power saving will be about 42% ($0.76^2=0.58$).

For a strip plating line, the expected rectifier power saving will even be much larger (60%!), because the diffusion flux is proportional with $\nu^{-0.59}$ (Landau, Electrochem. Society Proceedings, 101 (1995), 108):

$$J=0.01D^{0.67}\nu^{-0.59}L^{-0.08}(c_b-c_s)v_s^{0.92}$$

$$\frac{P_{Na_2SO_4}}{P_{K_2SO_4}}=\left(\frac{1.89\times10^{-6}}{8.64\times10^{-7}}\right)^{-0.59\times2}=0.40$$

Moreover, the conductivity of the $Na_2SO_4$ electrolyte is 11% larger, entailing an additional rectifier power saving.

The deposition of Cr in $mg\cdot m^{-2}$ versus i ($A\cdot dm^{-2}$) shows a threshold value before Cr—CrOx deposition starts, a peak followed by a sudden, steep decline ending in a plateau. Switching from a $K_2SO_4$ to a $Na_2SO_4$ electrolyte shows that a much lower current density is required for Cr—CrOx deposition. For depositing 100 $mg\cdot m^{-2}$ Cr—CrOx only 21.2 $A\cdot dm^{-2}$ is required instead of 34.6 $A\cdot dm^{-2}$ (see the arrows in FIG. 4). The decrease is larger than anticipated on the basis of the ratio in diffusion fluxes (0.61 versus 0.76), which is probably caused by the approximate character of the deposition mechanism.

XPS measurements show that there is no significant difference in the composition of the Cr—CrOx deposits produced from a $Na_2SO_4$ or $K_2SO_4$ electrolyte. The degree of porosity decreased with higher kinematic viscosity electrolytes due to the lower current densities required and the consequently reduced formation of $H_2$(g)-bubbles. The samples with a coating weight of about 100 $mg\cdot m^{-2}$ Cr—CrOx were also analysed by means of XPS (Table 4).

TABLE 4

Samples analysed by means of XPS.

| sample # | Type sulphate | i [A $dm^{-2}$] | t [s] | Cr—CrOx Cr total XPS [mg · $m^{-2}$] | Cr Metal XPS [mg · $m^{-2}$] | CrOx XPS [mg · $m^{-2}$] | Cr-carbide XPS [mg · $m^{-2}$] |
|---|---|---|---|---|---|---|---|
| 31 | $Na_2SO_4$ | 21.2 | 1.0 | 112.3 | 82 | 6.0 | 23.4 |
| 75 | $K_2SO_4$ | 34.6 | 1.0 | 117.3 | 75 | 6.3 | 35.4 |

The remainder is some $Cr_2(SO_4)_3$ (0.8 and 0.6 $mg\cdot m^{-2}$ respectively)

The current density for depositing 100 $mg/m^2$ Cr (which is a suitable target value for many applications) and the current density at which the maximum amount of Cr is deposited are given in Table 5. The concentration of the conductivity salt is limited by its solubility limit.

TABLE 5

Required current density for depositing 100 $mg/m^2$ Cr.

| conductivity salt | concentration ($g\ l^{-1}$) | concentration (M) | kinematic viscosity ($10^{-6}\ m^2\ s^{-1}$) | current density 100 mg $m^{-2}$ Cr (A $dm^{-2}$) |
|---|---|---|---|---|
| KCl | 250 | 3.35 | 0.87 | 34.5 |
| $K_2SO_4$ | 80 | 0.46 | 0.81 | 35.5 |
| $Na_2SO_4$ | 100 | 0.70 | 1.22 | 25.9 |
| $Na_2SO_4$ | 150 | 1.06 | 1.30 | 23.8 |
| $Na_2SO_4$ | 200 | 1.41 | 1.45 | 21.7 |
| $Na_2SO_4$ | 250 | 1.76 | 1.89 | 21.2 |

Clearly, the required current density for depositing 100 $mg/m^2$ Cr is shifted to a much lower value by using sodium sulphate as the conductivity salt (indicated by the arrow in the exploded view of FIG. 6) instead potassium chloride or potassium sulphate.

Beside the lower current densities and the associated obvious advantage there is also the reduced risk of formation of Cr(VI) (in case of Cr—CrOx) as a result of unwanted side reactions at the anode at lower current densities, the lifetime of the catalytic iridium oxide coating is extended, and the exhaust system for $H_2$(g) can be (much) smaller, because less $H_2$(g) is generated.

In an embodiment of the invention one or both sides of the electrically conductive substrate moving through the line is coated with a Cr—CrOx coating layer from a single electrolyte by using a plating process based on a trivalent chromium electrolyte that comprises a trivalent chromium compound, a chelating agent and a conductivity enhancing salt, wherein the electrolyte solution is preferably free of chloride ions and also preferably free of a buffering agent. A suitable buffering agent is boric acid, but this is a potentially hazardous chemical, so if possible its use should be avoided. This relatively simple aqueous electrolyte has proven to be most effective in depositing Cr—CrOx. The absence of chloride and the preferable absence of boric acid simplifies the chemistry, and also excludes the risk of the formation of chlorine gas, and makes the electrolyte more benign because of the absence of boric acid. This bath allows the deposition of Cr—CrOx in one step and from a single electrolyte, rather than forming the Cr metal first in one electrolyte and then producing a CrOx coating on top in another electrolyte. Consequently, chromium oxide is distributed throughout the chromium-chromium oxide coating obtained from a one-step deposition process, whereas in a two-step process the chromium oxide is concentrated at the surface of the chromium-chromium oxide coating.

According to U.S. Pat. No. 6,004,448 two different electrolytes are required for the production of ECCS via trivalent Cr chemistry. Cr metal is deposited from a first electrolyte with a boric acid buffer and subsequently Cr oxide is deposited from a second electrolyte without a boric acid buffer. According to this patent application in a continuous high speed line the problem arises that boric acid from the first electrolyte will be increasingly introduced in the second electrolyte due to drag-out from the vessel containing the first electrolyte into the vessel containing the second electrolyte and as a result Cr metal deposition increases and Cr oxide deposition decreases or is even terminated. This problem is solved by adding a complexing agent to the second electrolyte that neutralizes the buffer that has been introduced. The present inventors discovered that for the production of ECCS via trivalent Cr chemistry only one simple electrolyte without a buffer is required. Even though this simple electrolyte does not contain a buffer it was found by the present inventors that surprisingly also Cr metal is deposited from this electrolyte due to partial reduction of Cr oxide into Cr metal. This discovery simplifies the overall ECCS production enormously, because an electrolyte with a buffer for depositing Cr metal is not required as is wrongfully assumed by U.S. Pat. No. 6,004,488, but only one simple electrolyte without a buffer, which also solves the problem of contamination of this electrolyte with a buffer.

In an embodiment of the invention the diffusion flux of $H^+$-ions from the bulk of the electrolyte to the substrate/electrolyte interface is reduced by increasing the kinematic viscosity of the electrolyte and/or by moving the strip and the electrolyte through the plating line in concurrent flow wherein the metal strip is transported through the plating line with a velocity (v1) of at least 100 $m \cdot s^{-1}$ and wherein the electrolyte is transported through the strip plating line with a velocity of v2 ($m \cdot s^{-1}$). Both result in a thicker diffusion layer which is beneficial for the Cr—CrOx deposition by counteracting the increase of pH by reducing the diffusion flux of $H^+$-ions from the bulk of the electrolyte to the substrate/electrolyte interface.

In an embodiment of the invention the kinematic viscosity is increased by using a suitable conductivity enhancing salt in such a concentration so as to obtain an electrolyte with a kinematic viscosity of at least $1 \cdot 10^{-6}$ $m^2 \cdot s^{-1}$ (1.0 cSt) when the kinematic viscosity is measured at 50° C. Note that this does not mean that the electrolyte is solely used at 50° C. The temperature of 50° C. is intended here to provide a reference point for the measurement of the kinematic viscosity. In a preferable embodiment of the invention the kinematic viscosity of the electrolyte is at least $1.25 \cdot 10^{-6}$ $m^2 \cdot s^{-1}$ (1.25 cSt), more preferably at least $1.50 \cdot 10^{-6}$ $m^2 \cdot s^{-1}$ (1.50 cSt) and even more preferably $1.75 \cdot 10^{-6}$ $m^2 \cdot s^{-1}$ (1.75 cSt), all when measured at 50° C. Although physically there is no limit to the upper boundary of the kinematic viscosity, as long as the electrolyte stays liquid, each increase will lead to a more viscous electrolyte, and at some stage the viscosity will start to cause practical problems with increased drag-out (a more viscous liquid will stick to the strip) and more stringent wiping actions. A suitable upper limit for the kinematic viscosity is $1 \cdot 10^{-5}$ $m^2 \cdot s^{-1}$.

In an embodiment of the invention the kinematic viscosity is increased by using sodium sulphate as the conductivity enhancing salt. By using this salt, which has a high solubility in water, the conductivity can be increased to the same level as potassium sulphate, or even exceed that, and simultaneously produce a higher kinematic viscosity.

In an embodiment of the invention the kinematic viscosity is increased by using a thickening agent. The kinematic viscosity can also be increased by making the electrolyte more viscous by adding a thickening agent.

The thickening agent can be inorganic, for example a pyrogenic silica, or organic, for example a polysaccharide. Examples of suitable polysaccharide gelling or thickening agents are cellulose ethers such as methyl cellulose, hydroxypropyl methyl cellulose, hydroxyethyl cellulose, ethyl cellulose or sodium carboxymethyl cellulose, alginic acid or a salt thereof such as sodium alginate, gum arabic, gum karaya, agar, guar gum or hydroxypropyl guar gum, locust bean gum. Polysaccharides made by microbial fermentation can be used, for example xanthan gum. Mixtures of polysaccharides can be used and may be advantageous in giving a low shear viscosity which is temperature stable. An alternative organic gelling agent is gelatin. Synthetic polymeric gelling or thickening agents such as polymers of acrylamide or acrylic acid or salts thereof, e.g. polyacrylamide, partially hydrolysed polyacrylamide or sodium polyacrylate, or polyvinyl alcohol can alternatively be used. Preferably the thickening agent is a polysaccharide.

In an embodiment of the invention the chelating agent is sodium formate. By using sodium formate rather than e.g. potassium formate the chemistry is further simplified. The composition of the deposited layers is unaffected by this change.

In another embodiment of the invention the thickness of the diffusion layer is increased by moving the strip substrate and the electrolyte through the strip plating line in concurrent flow wherein the ratio of (v1/v2) is at least 0.1 and/or at most 10. If v1/v2=1, then the strip substrate and the electrolyte move at the same speed. It is preferable that the flow regime is a laminar flow. Turbulence will adversely affect the thickness of the diffusion layer.

In an embodiment of the invention the ratio of (v1/v2) is at least 0.25 and/or at most 4. In a preferable embodiment of the invention the ratio of (v1/v2) is at least 0.5 and/or at most 2.

In an embodiment of the invention a plurality (>1) of Cr—CrOx coating layers is deposited onto one or both sides of the electrically conductive substrate, wherein each layer is deposited in a single step in subsequent plating cells, in subsequent passes through the same plating line or in subsequent passes through subsequent plating lines.

The mechanism of deposition of CrOx is driven by the increase of the surface pH due to the reduction of $H^+$ to $H_2(g)$ at the strip surface (the cathode). This means that hydrogen bubbles form at the strip surface. The majority of these bubbles are dislodged during the plating process, but a minority may adhere to the substrate for a time sufficient to cause underplating at those spots potentially leading to a small degree porosity of the metal and metal oxide layer (Cr—CrOx). The degree of porosity of the coating layer is reduced by depositing a plurality (>1) of Cr—CrOx coating layers on top of each other on one or both sides of the electrically conductive substrate. For instance: Conventionally, a layer of chromium (Cr) is first deposited and then a CrOx layer is produced on top in a second process step. In the process according to the invention Cr and CrOx are formed simultaneously (i.e. in one step), indicated as a Cr—CrOx layer. However, even the product with a single layer, and thus having some porosity in the Cr—CrOx coating layer, passed all the performance tests for a packaging application where the steel substrate with the Cr—CrOx coating layer is provided with a polymer coating. Its performance is thus comparable to the conventional (Cr(VI)- based!) ECCS material with a polymer coating. The degree of porosity is reduced by depositing a plurality (>1) of Cr—CrOx coating layers on top of each other on one or on both sides of the electrically conductive substrate. In this case each single Cr—CrOx layer is deposited in a single step, and multiple single layers are deposited e.g. in subsequent plating cells or in subsequent plating lines, or by going through a single cell or plating line more than once. This further reduces the porosity of the Cr—CrOx coating system as a whole.

In between the deposition of the multiple layers, it may be desirable, or even necessary, that the hydrogen bubbles are removed from the surface of the strip. This may happen e.g. by the strip exiting and re-entering the electrolyte, by using a pulse plate rectifier or by a mechanical action such as a shaking action or a brushing action.

In a preferable embodiment of the invention the electrolyte consists of an aqueous solution of chromium (III) sulphate, sodium sulphate and sodium formate, unavoidable impurities and optionally sulphuric acid, the aqueous electrolyte having a pH at 25° C. of between 2.5 and 3.5, preferably at least 2.7 and/or at most 3.1. During plating some material from the substrate may dissolve and end up in the electrolyte. This would be considered an unavoidable impurity in the bath. Also, when using not 100% pure chemicals to produce or maintain the electrolyte there may be something in the bath which was not intended to be there. This would also be considered an unavoidable impurity in the bath. Any unavoidable side reactions resulting in the presence of materials in the electrolyte which were not there in the beginning are also considered an unavoidable impurity in the bath. The intention is that the bath is an aqueous solution to which only chromium (III) sulphate, sodium sulphate and sodium formate (all added in a suitable form), and optionally sulphuric acid to adjust the pH are added during the initial preparation of the bath and replenishment of the bath during its use. The electrolyte needs to be replenished during its use as a result of the occurrence of drag-out (electrolyte sticking to the strip) and as a result of the deposition of (Cr—)CrOx from the electrolyte.

Preferably the electrolyte for depositing the Cr—CrOx layer in a single step consists of an aqueous solution of chromium (III) sulphate, sodium sulphate and sodium formate and optionally sulphuric acid, the aqueous electrolyte having a pH at 25° C. of between 2.5 and 3.5, preferably at least 2.7 and/or at most 3.1. Preferably the electrolyte contains between 80 and 200 $g \cdot l^{-1}$ of chromium (III) sulphate, preferably between 80 and 160 $g \cdot l^{-1}$ of chromium (III) sulphate, between 80 and 320 $g \cdot l^{-1}$ sodium sulphate, more preferably between 100 and 320 $g \cdot l^{-1}$ sodium sulphate, even more preferably between 160 and 320 $g \cdot l^{-1}$ sodium sulphate and between 30 and 80 $g \cdot l^{-1}$ sodium formate.

Although the method according to the invention is applicable to any electrically conductive substrate, it is preferred to select the electrically conductive substrate from:

- tinplate, as deposited or flow-melted;
- tinplate, diffusion annealed with an iron-tin alloy consisting of at least 80% of FeSn (50 at. % iron and 50 at. % tin);
- cold-rolled full-hard blackplate, single or double reduced;
- cold-rolled and recrystallisation annealed blackplate;
- cold-rolled and recovery annealed blackplate, wherein the resulting coated steel substrate is intended for use in packaging applications.

The second aspect of the invention relates to coated metal strip produced in accordance with the method according to the invention.

The third aspect of the invention relates to a packaging produced from the coated metal strip produced in accordance with the method according to the invention.

Figure 1:
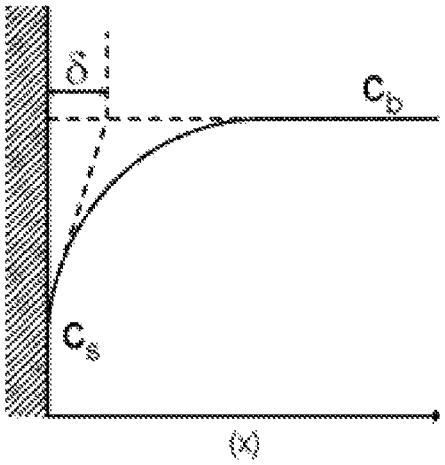
FIG. 1 shows the concentration gradient of the $H^+$-ions from at the electrode ($c_s$) (the dashed block, at x=0) to the bulk concentration ($c_b$). The δ indicated the stagnant layer (diffusion layer thickness) in the Nernst diffusion layer concept. Outside this layer, convection maintains the concentration uniform at the bulk concentration. Within this layer, mass transfer occurs only by diffusion. The thickness of δ is determined by the gradient of concentration at the electrode $(\partial c/\partial x)_{x=0}$.
Figure 2:
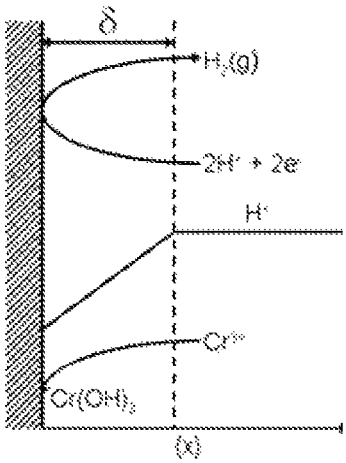
FIG. 2 is a schematical representation of the mechanism of the deposition of $Cr(OH)_3$ on the substrate. Note that the $H^+$-concentration profile is approximated by a straight line for simplicity. The δ again indicates the stagnant layer in the Nernst diffusion layer concept.
Figure 3:
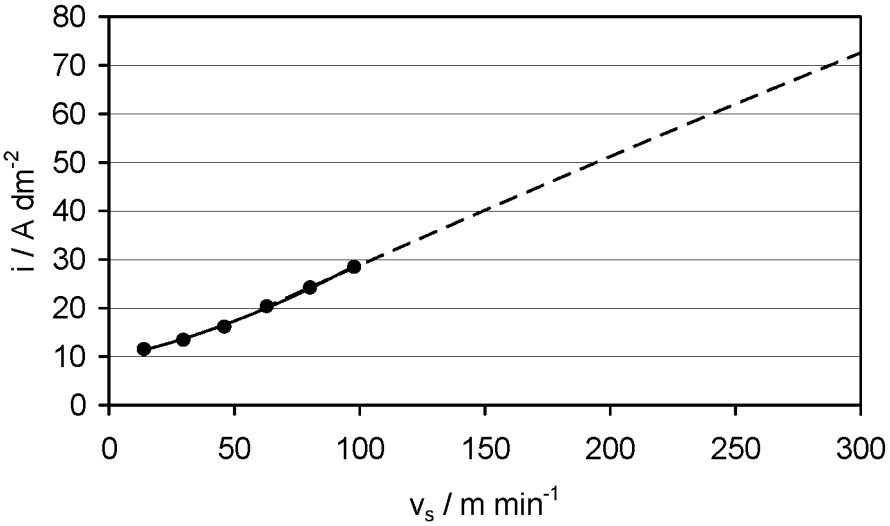
FIG. 3 shows how the required current density for the deposition of a fixed amount of $Cr(OH)_3$ increases when the speed of the strip moving through a plating line increases. For electrodeposition based on $Me^{n+}(aq)+n \cdot e^- \rightarrow Me(s)$ the increase of current density would be sufficient. For the mechanism based on deposition of $Cr(OH)_3$ the high speeds result in a thinner diffusion layer thickness, and therefore the unwanted diffusion of $H^+$ to the electrode speeds up as well. Measurements have indicated that for a line speed of 100 $m \cdot min^{-1}$ a current density of 24.3 $A \cdot dm^{-2}$ is needed for depositing 60 $mg \cdot m^{-2}$ Cr—CrOx, whereas for 300 m/min 73 $A \cdot dm^{-2}$ is needed and for 600 $m \cdot min^{-1}$ nearly 150 $A \cdot dm^{-2}$ is needed.
Figure 4:
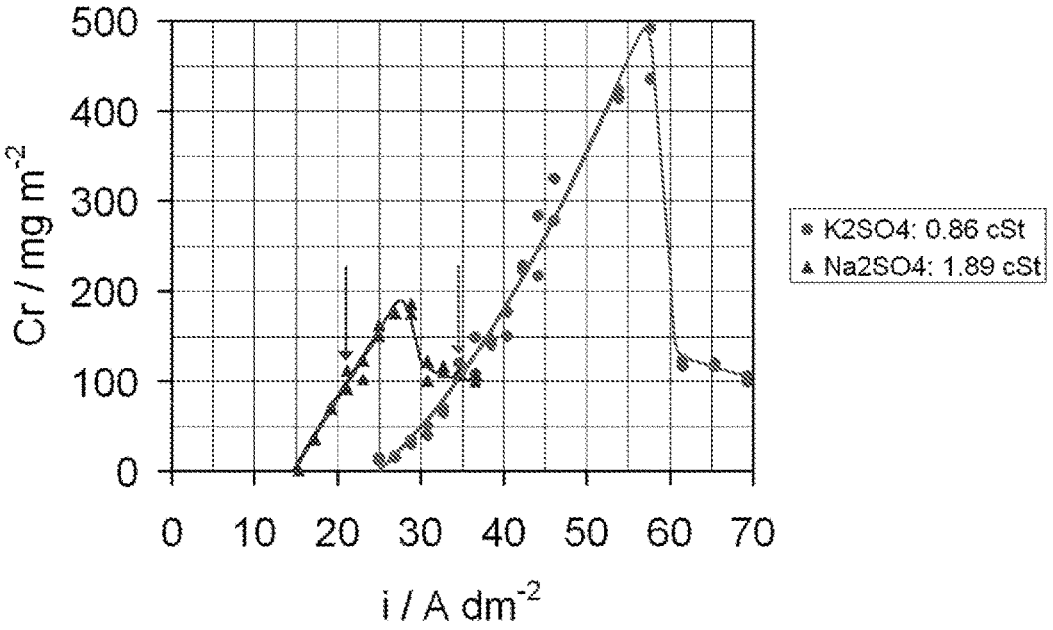
FIG. 4 shows the Cr—CrOx vs. current density plots: a threshold value before Cr—CrOx deposition starts, a peak followed by a sudden, steep decline ending in a plateau.
Figure 5:
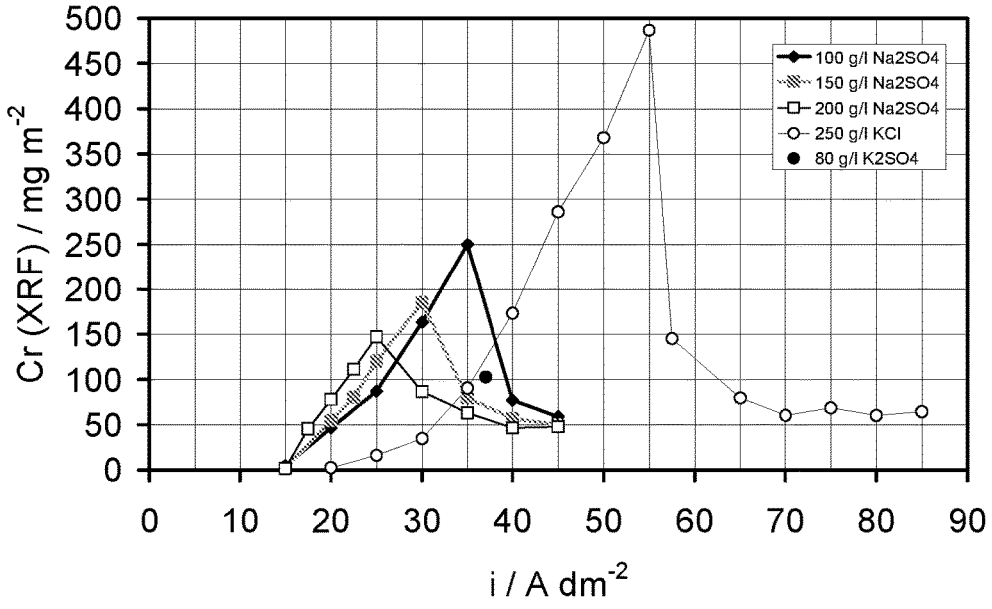
FIG. 5 shows Cr—CrOx vs. current density plots for different electrolytes and for varying amounts of sodium phosphate.
Figure 6:
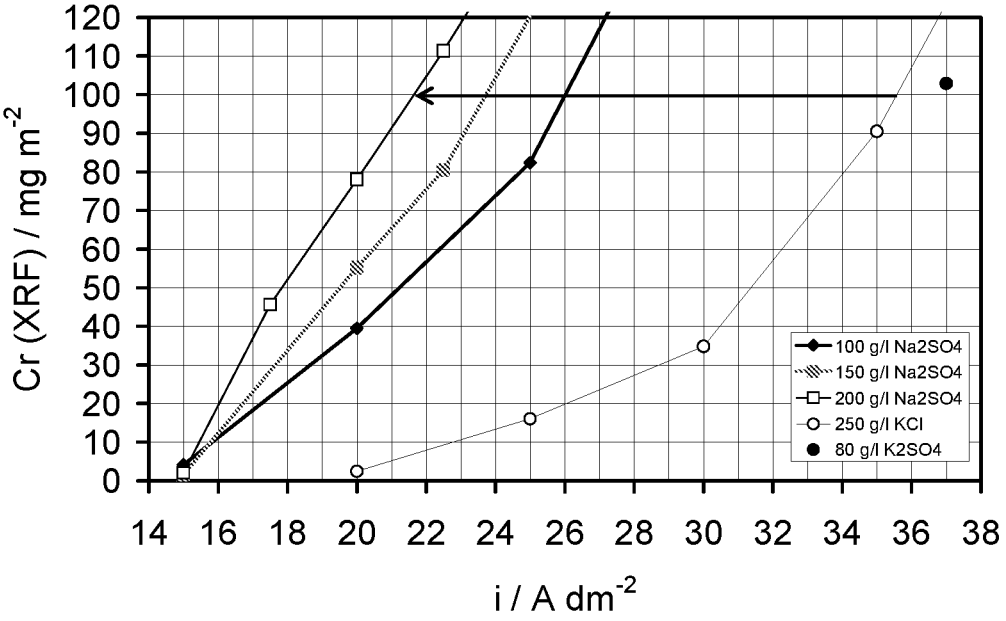
FIG. 6 shows a cut-out from FIG. 5 which shows the current density for depositing 100 $mg/m^2$ Cr, which is a suitable target value.
Figure 7:
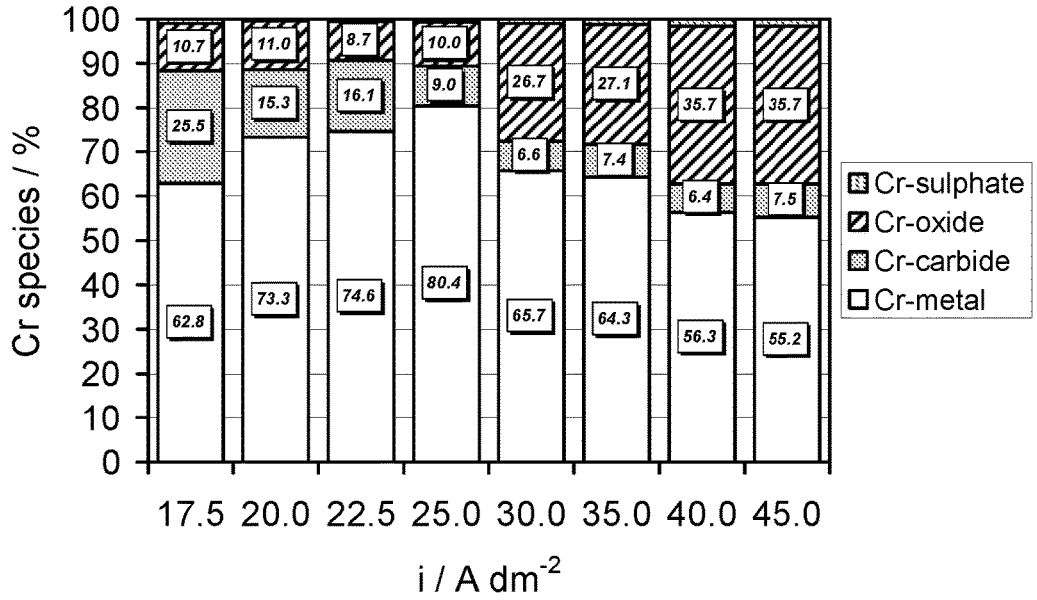
FIG. 7 plots the coating composition is vs. current density for 200 g/l $Na_2SO_4$ for a deposition time of 1 second, and in FIG. 8, the coating composition weight is plotted vs. deposition time for a current density of 20 $A/dm^2$ and for 200 g/l $Na_2SO_4$. Beyond the maximum current density (Regime III—as depicted in FIGS. 4 and 5, which for 200 g/l $Na_2SO_4$ is about 25 $A/dm^2$) the amount of Cr-metal drops and the coating is increasingly composed of Cr-oxide with increasing current density. In the linear regime II towards the maximum the Cr-metal content increases with increasing electrolysis time mainly at the expense of Cr oxide. The amount of Cr-carbide is about the same for all deposition times in FIG. 8.
Figure 8:
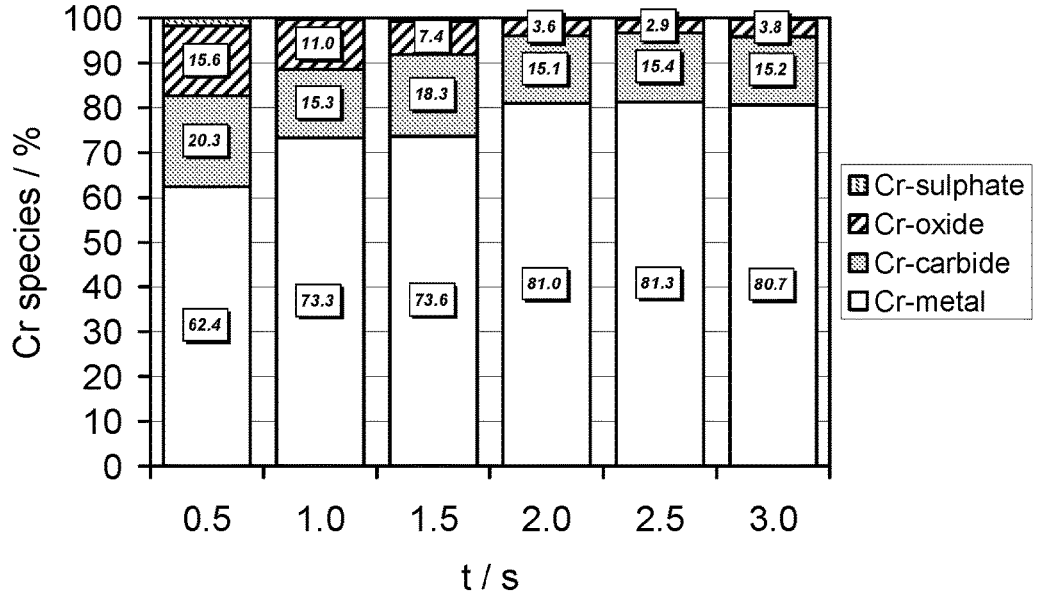

The invention claimed is:

1. A method for producing a steel strip-coated with a mixed chromium metal-chromium oxide (Cr—CrOx) coating layer, comprising:

transporting a moving steel strip through a plating line with a velocity v1 of at least 100 $m \cdot min^{-1}$, the plating line containing a single electrolyte solution comprising trivalent chromium and the single electrolyte solution moving with a velocity v2;

wherein the single electrolyte solution is free of chloride ions, is free of a buffering agent and free of boric acid;

wherein the single electrolyte solution consists of an aqueous solution of chromium (III) sulphate, sodium sulphate as a conductivity enhancing salt and sodium formate as a chelating agent, unavoidable impurities and optionally sulphuric acid to adjust the pH, and optionally a thickening agent, forming the mixed chromium metal-chromium oxide (Cr—CrOx) coating layer upon one or both sides of the steel strip, the Cr—CrOx coating layer being formed in a plating process from the single electrolyte solution in the plating line;

wherein the steel strip acts as a cathode, reducing $H^+$ to $H_2(g)$ at an interface between the steel strip and the single electrolyte solution to increase the pH at the interface between the steel strip and the single electrolyte solution and drive Cr—CrOx deposition for forming the mixed chromium metal-chromium oxide (Cr—CrOx) coating layer; and using the sodium sulfate in a sufficient concentration for increasing a kinematic viscosity of the single electrolyte solution to be $1\cdot10^{-6}$ $m^2\cdot s^{-1}$ (1.0 cSt) to $1\cdot10^{-5}$ $m^2\cdot s^{-1}$ when measured at 50° C. and reduce diffusion flux of $H^+$ ions to the interface between the steel strip and the single electrolyte solution, wherein the sodium sulphate concentration is between 100 and 320 $g\cdot l^{-1}$, wherein reducing the diffusion flux of $H^+$ ions reduces current density at the interface to deposit Cr—CrOx.

2. The method according to claim 1, wherein the kinematic viscosity is increased by using sodium sulphate as the conductivity enhancing salt at concentration from 150 to 250 $g\cdot l^{-1}$.

3. The method according to claim 1, wherein the kinematic viscosity is increased by using the conductivity enhancing salt in a concentration for the kinematic viscosity to be $1.75\cdot10^{-6}$ $m^2\cdot s^{-1}$ (1.0 cSt) to $1\cdot10^{-5}$ $m^2\cdot s^{-1}$ when measured at 50° C.

4. The method according to claim 1, wherein the single electrolyte solution has a pH at 25° C. of between 2.5 and 3.5, wherein the kinematic viscosity is increased by using sodium sulphate as the conductivity enhancing salt at concentration from greater than 100 to at most 250 $g\cdot l^{-1}$ for the kinematic viscosity to be $1.22\cdot10^{-6}$ $m^2\cdot s^{-1}$ to $1.89\cdot10^{-6}$ $m^2\cdot s^{-1}$ when measured at 50° C.

5. The method according to claim 1, further comprising increasing the kinematic viscosity by using the thickening agent and chromium in the single electrolyte solution is solely from chromium (III) sulphate.

6. The method according to claim 4, wherein the steel strip velocity v1 is 500 to 900 $m\cdot min^{-1}$, further comprising increasing the kinematic viscosity by transporting the steel strip and the single electrolyte solution through the plating line in a concurrent flow arrangement, wherein the steel strip and the single electrolyte solution move through the plating line in the concurrent flow arrangement at a ratio of v1/v2 of 0.25-4.

7. The method according to claim 1, wherein the steel strip velocity v1 is 500 to 900 $m\cdot min^{-1}$, further comprising increasing the kinematic viscosity by transporting the steel strip and the single electrolyte solution through the plating line in a concurrent flow arrangement, wherein the steel strip and the single electrolyte solution move through the plating line in the concurrent flow arrangement at a ratio of v1/v2 of between 0.1 and 10.

8. The method according to claim 1, wherein a plurality (>1) of Cr—CrOx coating layers are deposited onto one or both sides of the steel strip, wherein each layer is deposited in a single step in subsequent plating cells, in subsequent passes through the same plating line, or in subsequent passes through subsequent plating lines.

9. The method according to claim 1, wherein the single electrolyte solution has a pH at 25° C. of between 2.5 and 3.5, and wherein the unavoidable impurities are selected from the group consisting of dissolved steel strip, and an impurity in one or more chemicals included in the single electrolyte solution, the sodium sulfate at a concentration between 100 and 320 $g\cdot l^{-1}$.

10. The method according to claim 1, wherein the steel strip, prior to being coated with the Cr—CrOx coating layer is one of:

as-deposited tinplate, -or flow-melted tinplate;

tinplate that is diffusion annealed with an iron-tin alloy consisting of at least 80% of FeSn (50 at. % iron and 50 at. % tin);

single-reduced cold-rolled full-hard blackplate, or double-reduced cold-rolled full-hard blackplate;

cold-rolled and recrystallisation annealed blackplate;

cold-rolled and recovery annealed blackplate;

wherein the steel strip is intended for use in packaging applications after coating with the Cr—CrOx coating.

11. The method according to claim 1, wherein the thickening agent comprises a polysaccharide, wherein the kinematic viscosity is increased by using the polysaccharide and wherein the chromium in the single electrolyte solution is solely from chromium (III) sulphate.

12. The method according to claim 1, wherein the single-electrolyte solution having a pH at 25° C. of between 2.5 and 3.1, and wherein the unavoidable impurities are selected from the group consisting of dissolved steel strip, and an impurity in one or more chemicals included in the single electrolyte solution, wherein said sodium sulfate is at a concentration between 100 and 320 $g\cdot l^{-1}$.

13. The method according to claim 1, the single electrolyte solution having a pH at 25° C. of between 2.7 and 3.1, and wherein the unavoidable impurities are selected from the group consisting of dissolved steel strip, and an impurity in one or more chemicals included in the single electrolyte solution, wherein said sodium sulfate is at a concentration from 150 to less than 320 $g\cdot l^{-1}$.

14. The method according to claim 1, wherein the steel strip and the single electrolyte solution move through the plating line in a concurrent flow arrangement.

15. The method according to claim 1, wherein the steel strip and the single electrolyte solution move through the plating line in a concurrent flow arrangement at a ratio of v1/v2 of between 0.1 and 10.

16. The method according to claim 4, wherein the single electrolyte solution has a pH at 25° C. of between 2.7 and 3.5.

17. The method according to claim 16, wherein the single electrolyte solution has a pH at 25° C. of between 2.7 and 3.1, wherein the kinematic viscosity is increased by using sodium sulphate as the conductivity enhancing salt at concentration from 150 to 250 $g\cdot l^{-1}$ for the kinematic viscosity to be $1.30\cdot10^{-6}$ $m^2\cdot s^{-1}$ to $1.89\cdot10^{-6}$ $m^2\cdot s^{-1}$ when measured at 50° C. and wherein the sodium formate is at concentration between 30 and 80 $g\cdot l^{-1}$.

* * * * *